US009946176B2

(12) United States Patent
Maeda et al.

(10) Patent No.: US 9,946,176 B2
(45) Date of Patent: Apr. 17, 2018

(54) ELECTROPHOTOGRAPHIC PHOTORECEPTOR

(71) Applicant: Konica Minolta, Inc., Tokyo (JP)

(72) Inventors: Seisuke Maeda, Fussa (JP); Kazuhiro Kuramochi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/074,350

(22) Filed: Mar. 18, 2016

(65) Prior Publication Data

US 2016/0282735 A1 Sep. 29, 2016

(30) Foreign Application Priority Data

Mar. 26, 2015 (JP) ..... 2015-063772

(51) Int. Cl.
*G03G 5/147* (2006.01)

(52) U.S. Cl.
CPC ..... *G03G 5/14734* (2013.01); *G03G 5/14704* (2013.01); *G03G 5/14726* (2013.01)

(58) Field of Classification Search
CPC ..... G03G 5/14704; G03G 5/14726; G03G 5/14734
USPC ..... 430/67, 66
See application file for complete search history.

(56) References Cited

U.S. PATENT DOCUMENTS 5,693,443 A * 12/1997 Nakamura ..... G03G 5/14734 399/297

FOREIGN PATENT DOCUMENTS

| | | | |
|---|---|---|---|
| JP | 02-176666 A | * | 7/1990 |
| JP | H02-176666 A | | 7/1990 |
| JP | 2009053727 A | | 3/2009 |
| JP | 2011128546 A | | 6/2011 |
| JP | 2011197443 A | | 10/2011 |

OTHER PUBLICATIONS

Japanese Patent Office J-PlatPat machine-assisted English-language translation of JP 02-176666 (pub. Jul. 1990).*
Notification of Reasons of Rejection dated Feb. 14, 2017 from the corresponding Japanese Application No. JP 2015-063772; English translation of Notification of Reasons of Rejection; Total of 8 pages.

* cited by examiner

*Primary Examiner* — Janis L Dote
(74) *Attorney, Agent, or Firm* — Lucas & Mercanti, LLP

(57) ABSTRACT

Provided is an electrophotographic photoreceptor containing a conductive support having thereon a photosensitive layer and a surface layer laminated in that order, wherein the surface layer contains a conductive filler having a number average primary particle size of 10 to 500 nm in a resin; and the conductive filler is treated with a surface treatment agent containing a fluoroalkyl (meth)acrylate/(meth)acrylic acid copolymer.

8 Claims, 2 Drawing Sheets

ELECTROPHOTOGRAPHIC PHOTORECEPTOR

This application is based on Japanese Patent Application No. 2015-063772 filed on Mar. 26, 2015 with Japan Patent Office, the entire content of which is hereby incorporated by reference.

TECHNICAL FIELD

The present invention relates to an electrophotographic photoreceptor used for an image-forming apparatus employing an electrophotographic method.

BACKGROUND

In the field of an electrophotographic photoreceptor which constitutes an image-forming apparatus such as a copier or a printer employing an electrophotographic method, there was proposed a method of adding a conductive filler having a low powder resistance in the surface layer of the photoreceptor as a resistance component in order to prevent generation of image faults such as memory in the photoreceptor. When the above-described conductive filler is added to the surface layer of the photoreceptor, if the powder resistance of the conductive filler is too low, the charging property of the photoreceptor will become lowered to result in producing charging failure and fog. Therefore, it is required to suitably adjust the powder resistance of the added conductive filler. As a method of adjusting the powder resistance of the conductive filler, there was done a surface treatment by using a coupling agent such as a silane coupling agent (refer to Patent document 1: JP-A No. 2009-53727).

On the other hand, in order to improve the cleaning property, there was known a method of adding a lubricating filler which gives a low friction property to the surface layer of the photoreceptor, for example, organic particles made of polytetrafluoroethylene (PTFE) (refer to Patent document 2: JP-A No. 2011-197443), or composite particles composed of inorganic particles and a fluorine resin (refer to Patent document 3: JP-A No. 2011-128546).

However, in the case of adding the lubricating filler to the surface layer, the dispersion condition of the lubricating filler in the coating liquid for forming the surface layer may be insufficient, since the lubricating filler will repel the resin which constitutes the surface layer due to the low surface energy of the lubricating filler. As a result, it is difficult to obtain a sufficient strength against scratching. There is even a case in which addition of the lubricating filler may cause a cleaning failure. When the lubricating filler is an insulator, the electric property of the surface layer may be deteriorated.

The problem of the dispersibility of the lubricating filler in the coating liquid may be resolved by using a dispersion auxiliary agent. When this dispersion auxiliary agent is an insulator, the electric property of the surface layer may be deteriorated.

There is a limitation of regulating the powder resistance of the conductive filler to the required condition by the surface treatment. Further, when it is used the conductive filler having been subjected to a surface treatment with a coupling agent, there may be produced a problem relating to the low dispersion in the coating liquid in the same manner as the lubricating filler.

As described above, the use of the conductive filler or the lubricating filler is effective as a method of obtaining a surface layer having high strength with excellent cleaning property, and a required electric property for forming an image of high quality. However, it is difficult to fully obtain the required properties that are possessed by the conductive filler or the lubricating filler.

SUMMARY

The present invention was done based on the above-described situation. An object of the present invention is to provide an electrophotographic photoreceptor having high strength with excellent cleaning property and required electric property, and capable of forming an image of high quality.

An electrophotographic photoreceptor of the present invention is characterized in the following.

An electrophotographic photoreceptor comprising a conductive support having thereon a photosensitive layer and a surface layer laminated in that order, wherein the surface layer contains a conductive filler having a number average primary particle size of 10 to 500 nm in a resin, and the conductive filler is treated with a surface treatment agent containing a fluoroalkyl (meth)acrylate/(meth)acrylic acid copolymer.

Here, the term "(meth)acrylate" indicates both methacrylate and acrylate. In the same way, the term "(meth)acrylic acid" indicates both methacrylic acid and acrylic acid.

In the electrophotographic photoreceptor of the present invention, it is preferable that the fluoroalkyl (meth)acrylate/(meth)acrylic acid copolymer contains both a structure unit represented by Formula (1a) and a structure unit represented by Formula (1b) as indicated below.

Formula (1a)

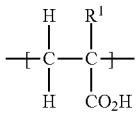

Formula (1b)

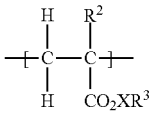

Wherein, $R^1$ represents a hydrogen atom or a methyl group; $R^2$ represents a straight-chain or a branched-chain alkyl group having 1 to 4 carbon atoms; X represents an alkylene group having 1 to 4 carbon atoms; and $R^3$ represents a perfluoroalkyl group having 1 to 5 carbon atoms.

In the electrophotographic photoreceptor of the present invention, it is preferable that the conductive filler is treated with both the surface treatment agent containing the fluoroalkyl (meth)acrylate/(meth)acrylic acid copolymer and a coupling agent containing an acryloyl group or a methacryloyl group.

In the electrophotographic photoreceptor of the present invention, it is preferable that the conductive filler is at least one selected from the group consisting of titanium oxide, tin oxide and copper alumina.

In the electrophotographic photoreceptor of the present invention, it is preferable that the resin which composes the surface layer is a cured resin obtained by polymerization of a cross-linking polymerizable compound containing an acryloyl group or a methacryloyl group.

The electrophotographic photoreceptor of the present invention has a surface layer containing a conductive filler which is treated with a surface treatment agent containing a fluoroalkyl (meth)acrylate/(meth)acrylic acid copolymer. By using this photoreceptor, it is possible to provide an electrophotographic photoreceptor having high strength with excellent cleaning property and required electric property, and capable of forming an image of high quality.

DESCRIPTION OF THE PREFERRED EMBODIMENTS

The present invention will be specifically described in the following.

[Photoreceptor]

The photoreceptor of the present invention includes a conductive support having thereon a photosensitive layer and a surface layer laminated in that order.

The photosensitive layer may have a multilayer configuration including a charge generating layer and a charge transporting layer, or it may have a single-layer configuration containing a mixture of a charge generating material and a charge transporting material.

In the present invention, an organic photoreceptor designates a member in which one of a charge generating function and a charge transporting function, both being essential to the constitution of the photoreceptor, is exhibited by an organic compound. The organic photoreceptor in the present invention includes: a photoreceptor containing an organic photosensitive layer composed of a known organic charge generating material and a known charge transporting material; and a photoreceptor composed of a polymer complex having a charge generating function and a charge transporting function.

Figure 1:
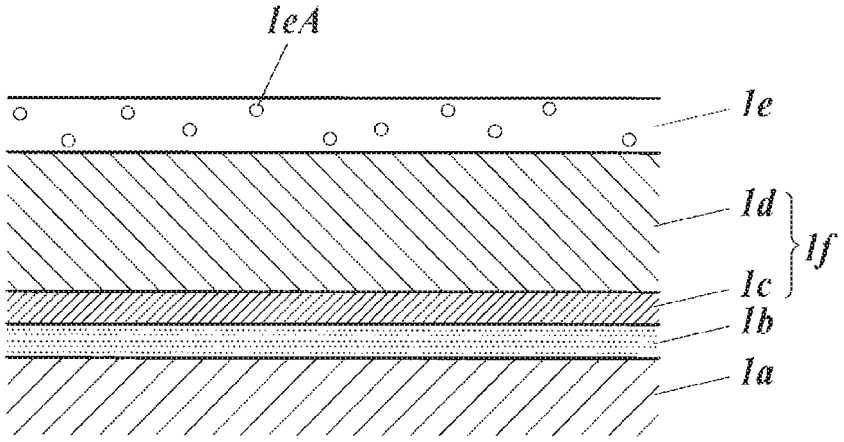
FIG. 1 is a partial cross-sectional view illustrating an example of a layer configuration of an electrophotographic photoreceptor of the present invention.

As illustrated in FIG. 1, a photoreceptor contains a conductive support 1*a* having thereon: an intermediate layer 1*b*, a charge generating layer 1*c*, a charge transporting layer 1*d*, and a surface layer 1*e* laminated in that order, for example. An organic photosensitive layer 1*f* essential to an organic photoreceptor is composed of the charge generating layer 1*c* and the charge transporting layer 1*d*.

[Surface Layer 1*e*]

The surface layer 1*e* which constitutes the photoreceptor of the present invention contains a binder resin (hereafter, it is called as "a binder resin for a surface layer) and a conductive filler 1*e*A having a number average primary particle size of 10 to 500 nm in the resin. The conductive filler is treated with a surface treatment agent (hereafter, it is called as "a specific fluorinated surface treatment agent") containing a fluoroalkyl (meth)acrylate/(meth)acrylic acid copolymer (hereafter, it is called as "a specific fluorinated polymer"). This filler 1*e*A is also called as "a conductive filler having been subjected to a specific surface treatment".

It is preferable that the conductive filler 1*e*A having been subjected to a specific surface treatment is treated with both: a surface treatment with a coupling agent containing an acryloyl group or a methacryloyl group; and a surface treatment with a specific fluorinated surface treatment agent.

By incorporating the conductive filler 1*e*A having been subjected to a specific surface treatment in the surface layer 1*e*, the photoreceptor exhibits high strength with excellent cleaning property, and the photoreceptor can acquire a required electric property enabling to form an image of high quality.

This is supposed to be achieved by the following mechanism. The specific fluorinated polymer contains both a carboxylic group and a fluoroalkyl group, which improve close adhesion. Therefore, when a surface treatment is done to the conductive filler, the specific fluorinated polymer molecules can be located on the surface of the conductive filler with high adhesion by the presence of the carboxylic groups. This will lead to obtain a high fluorine density. As a result, the conductive filler 1*e*A having been subjected to a specific surface treatment will have a low frictional property, and an excellent cleaning property of the surface layer will be obtained. Further, by the presence of the specific fluorinated polymer in the surface, the conductive filler 1*e*A having been subjected to a specific surface treatment will have an appropriate powder resistance. This will lead to obtain a required electric property.

In addition, since the conductive filler 1*e*A having been subjected to a specific surface treatment will have an excellent dispersion property in the solvent, the coating liquid will have an excellent dispersion property.

A number average primary particle size of the conductive filler having been subjected to a specific surface treatment is usually 10 to 50 nm.

By the fact that the particle size of the conductive filler having been subjected to the specific surface treatment is in the above-described range, sufficiently high film strength can be acquired.

The number average primary particle size of the conductive filler having been subjected to a specific surface treatment is determined as follows. The particles are photographed at a magnification of 100,000 with a scanning electron microscope (e.g., JSM-7500F, manufactured by JEOL Ltd.), and the photographic image including randomly selected 100 particles (excluding agglomerated particles) of the conductive filler read by a scanner is converted into a binary image with an automatic image analyzer (e.g., "LUZEX AP" with software version Ver. 1.32, manufactured by NIRECO Corporation). The horizontal Feret's diameters of the randomly selected 100 particles are calculated, and the average value of the Feret's diameters is defined as the number average primary particle size. As used herein, the "horizontal Feret's diameter" refers to the length of a side (parallel to the x-axis) of a rectangle circumscribing a binarized image of the conductive filler.

The conductive filler having been subjected to a specific surface treatment is preferably contained in an amount of 50 to 200 mass parts with respect to 100 mass parts of the binder resin for the surface layer, more preferably it is 70 to 180 mass parts.

By making the amount of the conductive filler having been subjected to a specific surface treatment to be 50 or more mass parts with respect to 100 mass parts of the binder resin for the surface layer, it can be certainly obtained the required electric property and a low friction property in the surface layer. On the other hand, by making the amount of the conductive filler having been subjected to a specific surface treatment to be 200 or less mass parts with respect to 100 mass parts of the binder resin, it can prevent deterioration of the formation of the coating film during the formation of the surface layer.

[Surface Treatment of Conductive Filler Employing Specific Fluorinated Surface Treatment Agent]

The conductive filler having been subjected to a specific surface treatment of the present invention is a material obtained by conducting a surface treatment to an untreated conductive filler as a raw material (it is called as an untreated conductive filler) with a specific fluorinated surface treatment agent.

An example of the surface treatment of the conductive filler with a specific fluorinated surface treatment agent is done as follows. An untreated conductive filler or a conductive filler treated with a coupling treatment (when it is required to conduct a surface treatment with a specific coupling agent) is dispersed in an alcohol type dispersion medium such as methanol and 2-butanol. A specific fluorinated surface treatment agent is added to the dispersion and mixed together. Then, the dispersion medium in the dispersion is evaporated or the dispersion is heated after evaporation of the dispersion medium. Thus the surface treatment of the conductive filler can be achieved.

[Untreated Conductive Filler]

The untreated conductive filler of the present invention may be composed of a single conductive material, or it may be composed of a compound material such as a compound particle having a core-shell structure in which a conductive shell material is formed on a surface of a core material.

The untreated conductive filler may be an n-type conductive filler, or a p-type conductive filler. An n-type conductive filler mainly exhibits an electron transport property, and a p-type conductive filler mainly exhibits a hole transport property.

As an n-type conductive filler, it can be used titanium oxide or tin oxide. As a p-type conductive filler, it can be used copper alumina.

[Specific Fluorinated Surface Treatment Agent]

The specific fluorinated surface treatment agent of the present invention does not require a reaction with a silanol group during a surface treatment, which is different from a generally known silanol coupling agent.

The specific fluorinated polymer constituting the specific fluorinated surface treatment agent is preferably composed of both a structure unit represented by the aforesaid Formula (1a) and a structure unit represented by the aforesaid Formula (1b).

In the aforesaid Formula (1a), $R^1$ represents a hydrogen atom or a methyl group.

In the aforesaid Formula (1b): $R^2$ represents a straight-chain or a branched-chain alkyl group having 1 to 4 carbon atoms; X represents an alkylene group having 1 to 4 carbon atoms; and $R^3$ represents a perfluoroalkyl group having 1 to 5 carbon atoms.

The specific fluorinated polymer preferably has a number average molecular weight of 5,000 to 30,000.

By making the molecular weight of the specific fluorinated polymer to be in the above-described range, it is possible to adjust the low friction property and the powder resistance of the conductive filler in the required range.

Examples of the specific fluorinated polymer are: 2,2,3,3,4,4,4-heptafluorobutyl methacrylate/acrylic acid copolymer, 2,2,3,3-tetrafluoropropyl methacrylate/acrylic acid copolymer, and 2,2,3,3,4,4,5,5,5-nonafluoropentyl methacrylate/acrylic acid copolymer.

These may be used alone, or they may be used by mixing two or more kinds.

The used amount of the specific fluorinated surface treatment agent is preferably 0.5 to 20 mass parts, more preferably 1 to 10 mass parts with respect to 100 mass parts of the untreated conductive filler.

The fact that the surface of the conductive filler is treated with a specific fluorinated surface treatment agent is confirmed with measurement by a differential thermal analysis and thermogravimetric analysis (TG/DTA).

[Surface Treatment of Conductive Filler Employing Specific Coupling Agent]

It is preferable that the conductive filler having been subjected to a specific surface treatment is also treated with a coupling agent containing an acryloyl group ($CH_2{=}CHCO{-}$) or a methacryloyl group ($CH_2{=}C(CH_3)CO{-}$), in addition to the surface treatment with the specific fluorinated surface treatment agent. It is particularly preferable that the untreated conductive filler is at first subjected to a surface treatment with a specific coupling agent, and subsequently subjected to a surface treatment with the specific fluorinated surface treatment agent. If the surface treatment with the specific coupling agent is done after carrying out the surface treatment with the specific fluorinated surface treatment agent, the specific coupling agent may not be introduced in the surface of the conductive filler due to the oil repelling effect by the fluorinated surface treatment agent. Consequently, the effect of the coupling agent may not be sufficiently obtained. Therefore, this treatment order is not preferable.

By employing the conductive filler having been subjected to a surface treatment with a specific coupling agent, when the binder resin for the surface layer is a cured resin obtained by polymerization of a cross-linking polymerizable compound containing an acryloyl group or a methacryloyl group, the coupling agent will react with the aforesaid polymerizable compound. As a result, it can be formed a surface layer having sufficiently high strength.

Specifically, the surface treatment of the conductive filler with a specific coupling agent is done as follows. A slurry containing an untreated conductive filler and a specific coupling agent (a suspension of solid particles) is pulverized in a wet state. The untreated conductive filler is made into minute particles, and at the same time, a coupling reaction of the particles is made to proceed. Subsequently, the solvent is removed to obtain a substance in a powder state.

It is preferable that the slurry is a mixture containing: 0.1 to 100 mass parts of the specific coupling agent; 50 to 5,000 mass parts of the solvent; and 100 mass parts of the untreated conductive filler.

As an apparatus used for wet pulverization of slurry, it can be cited a wet-media disperser.

The wet-media disperser has a container loaded with media beads and a stirring disk mounted vertically to a rotary shaft. The stirring disk rapidly spins to mill and disperse agglomerated particles of untreated conductive filler. It may be used any type of disperser which can sufficiently disperse the untreated conductive filler during the surface modification of the untreated conductive filler. Various types of dispersers may be used, such as a vertical type, a horizontal type, a continuous type, and a batch type.

Specific examples of a disperser include a sand mill, an Ultravisco mill, a pearl mill, a grain mill, a Dyno mill, an agitator mill, and a dynamic mill. Such a disperser pulverizes and disperses particles by impact cracking, friction, shear force, or shear stress provided by grinding media, such as balls and beads.

The beads used in the wet-media disperser may be spheres formed of, for example, glass, alumina, zircon, zirconia, steel, or flint. Particularly preferred beads are formed of zirconia or zircon. Although the diameter of the beads is usually about 1 to 2 mm, a preferred diameter is about 0.1 to 1.0 mm in the present invention.

The disk and the inner wall of the container of the wet-media disperser may be formed of any material, such as stainless steel, nylon, or ceramic. In the present invention, the disk and the inner wall of the container are preferably formed of a ceramic material, such as zirconia or silicon carbide.

[Specific Coupling Agent]

Examples of a specific coupling agent are: a silane coupling agent and a titanium coupling agent each having an acryloyl group or a methacryloyl group.

Examples of a silane coupling agent having an acryloyl group or a methacryloyl group are as follows.

S1: $CH_2{=}CHCOO(CH_2)_2Si(CH_3)(OCH_3)_2$
S2: $CH_2{=}CHCOO(CH_2)_2Si(OCH_3)_3$
S3: $CH_2{=}CHCOO(CH_2)_2Si(OC_2H_5)(OCH)_2$
S4: $CH_2{=}CHCOO(CH_2)_3Si(OCH_3)$
S5: $CH_2{=}CHCOO(CH_2)_2Si(CH_3)Cl_2$
S6: $CH_2{=}CHCOO(CH_2)_2SiCl_3$
S7: $CH_2{=}CHCOO(CH_2)_3Si(CH_3)Cl_2$
S8: $(CH_2)_3SiCl_3$
S9: $CH_2{=}C(CH_3)COO(CH_2)_2Si(CH_3)(OCH_3)_2$
S10: $CH_2{=}C(CH_3)COO(CH_2)_2Si(OCH_3)_3$
S11: $CH_2{=}C(CH_3)COO(CH_2)_3Si(CH_3)(OCH_3)_2$
S12: $CH_2{=}C(CH_3)COO(CH_2)_3Si(OCH_3)_3$
S13: $CH_2{=}C(CH_3)COO(CH_2)_2Si(CH_3)Cl_2$
314: $CH_2{=}C(CH_3)COO(CH_2)_2SiCl_3$
S15: $CH_2{=}C(CH_3)COO(CH_2)_3Si(CH_3)Cl_2$
S16: $CH_2{-}C(CH_3)COO(CH_2)_3SiCl_3$
S17: $CH_2{=}CHCOOSi(OCH_3)_3$
S18: $CH_2{=}CHCOOSi(OC_2H_5)_3$
S19: $CH_2{=}C(CH_3)COOSi(OCH_3)_3$
S20: $CH_2{=}C(CH_3)COOSi(OC_2H_5)_3$
S21: $CH_2{=}C(CH_2)COO(CH_2)_2Si(CH_3)(OC_2H_5)_3$
S22: $CH_2{=}CHCOO(CH_2)_2Si(CH_3)_2(OCH_3)$
S23: $CH_2{=}CHCOO(CH_2)_2Si(CH_3)(OCOCH_3)_2$
S24: $CH_2{=}CHCOO(CH_2)_2Si(CH_3)(ONHCH_3)_2$
S25: $CH_2{=}CHCOO(CH_2)_2Si(CH_3)(OC_6H_5)_2$
S26: $CH_2{=}CHCOO(CH_2)_2Si(C_{10}H_{21})(OCH_3)_2$
S27: $CH_2{=}CHCOO(CH_2)_2Si(CH_2C_6H_5)(OCH_3)_2$

An example of a titanium coupling agent having an acryloyl group or a methacryloyl group is titanium methacrylate triisopropoxide.

These specific coupling agents may be used alone, or they may be used by mixing two or more kinds.

The used amount of the specific coupling agent is preferably 1 to 15 mass parts, more preferably 3 to 10 mass parts with respect to 100 mass parts of the untreated conductive filler.

The fact that the surface of the conductive filler is treated with a specific coupling agent is confirmed with measurement by a differential thermal analysis and thermogravimetric analysis (TG/DTA).

[Binder Resin for Surface Layer]

A binder resin for a surface layer is preferably a heat curable resin or a photo curable resin. In particular, from the viewpoint of obtaining high film strength, a photo curable resin is preferably used.

Examples of a binder resin for a surface layer are: a polyvinyl butyral resin, an epoxy resin, a polyurethane resin, a phenol resin, a polyester resin, an alkyd resin, and a melamine resin.

When a heat curable resin is used, a polycarbonate resin is preferably used. When a photo curable resin is used, a cross-linking polymerizable compound containing an acryloyl group ($CH_2{=}CHCO{-}$) or a methacryloyl group ($CH_2{=}C(CH_3)CO{-}$) is preferable. Specifically, preferable is a cured resin obtained from a monomer or an oligomer each having two or more acryloyl groups or methacryloyl groups (it is called as "a multi-functional radical polymerizable compound") by irradiating with UV rays or electron beams. Consequently, a preferable curable resin is an acrylic resin formed with an acrylic monomer or its oligomer.

The above-described binder resins for a surface layer may be used alone, or they may be used by combining two or more kinds.

[Multi-Functional Radical Polymerizable Compound]

Examples of a multi-functional radical polymerizable compound are as follows.

M1

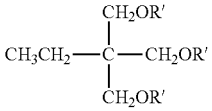

M2

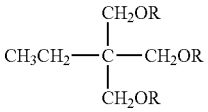

M3

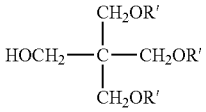

M4

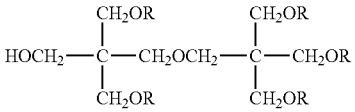

M5

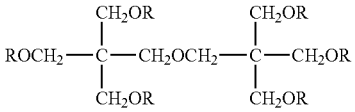

M6

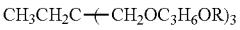

M7

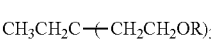

M8

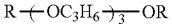

M9

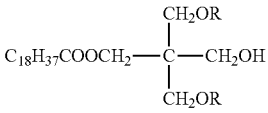

M10

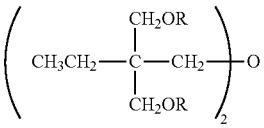

M11

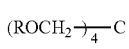

M12

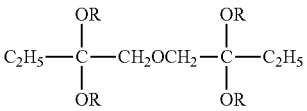

M13

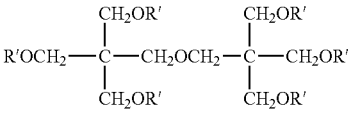

-continued

M14

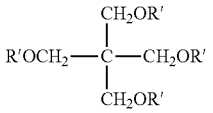

M15

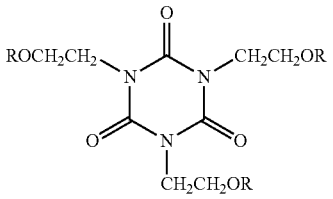

In the chemical formulas indicating the exemplary compounds M1 to M15, R represents an acryloyl group ($CH_2{=}CHCO{-}$), and R' represents a methacryloyl group ($CH_2{=}C(CH_3)CO{-}$).

The surface layer may contain various types of antioxidants or lubrication particles when needed in addition to the binder resin for a surface layer and the conductive filler treated with a specific surface treatment.

A thickness of the surface layer is preferably 0.2 to 10 μm, more preferably it is 0.5 to 6 μm.

[Formation of Surface Layer]

A surface layer can be formed with the following. A coating liquid is prepared by dissolving or dispersing in a solvent: a multi-functional radical polymerizable compound, a conductive filler having been subjected to a specific surface treatment, and a known resin, a polymerization initiator, or an antioxidant when needed. The prepared coating liquid is applied on the surface of the charge transporting layer to form a coating film. Then, it is cured to obtain a surface layer.

[Polymerization Initiator]

A polymerization initiator which may be incorporated in the surface layer is a radical polymerization initiator enabling to start polymerization of a multi-functional radical polymerizable compound. A heat polymerization initiator and a photo polymerization initiator may be cited.

As a method of making a polymerization reaction of a multi-functional radical polymerizable compound, it may be used a method of using a cleaving reaction with electron beams, or a method of using heat or light under the existence of a radical polymerization initiator.

Examples of a thermal polymerization initiator usable in the present invention include: azo compounds, such as 2,2'-azobisisobutyronitrile, 2,2'-azobis(2,4-dimethylazobisvaleronitrile), and 2,2'-azobis(2-methylbutyronitrile); and peroxides, such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of a photopolymerization initiator include: acetophenone and ketal initiators, such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 (Irgacure 369, manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; benzoin ether initiators, such as benzoin, benzoin methyl ether, benzoin ethyl ether, benzoin isobutyl ether, and benzoin isopropyl ether; benzophenone initiators, such as benzophenone, 4-hydroxybenzophenone, o-benzoyl methyl benzoate, 2-benzoylnaphthalene, 4-benzoylbiphenyl, 4-benzoyl phenyl ether, acrylated benzophenone, and 1,4-benzoylbenzene; and thioxanthone initiators, such as 2-isopropylthioxanthone, 2-chlorothioxanthone, 2,4-dimethylthioxanthone, 2,4-diethylthioxanthone, and 2,4-dichlorothioxanthone.

Other photopolymerization initiators include: ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide (Irgacure 819, manufactured by BASF Japan Ltd.), bis(2,4-dimethoxybenzoyl)-2,4,4-trimethylpentylphosphine oxide, methylphenylglyoxyester, 9,10-phenanthrene, acridine compounds, triazine compounds, and imidazole compounds.

A compound having a photopolymerization promoting effect may be used alone or in combination with any of the aforementioned photopolymerization initiators. Examples of a compound having a photopolymerization promoting effect include: triethanolamine, methyldiethanolamine, 4-dimethylaminoethyl benzoate, 4-dimethylaminoisoamyl benzoate, (2-dimethylamino)ethyl benzoate, and 4,4'-dimethylaminobenzophenone.

The polymerization initiator used in the present invention is preferably a photopolymerization initiator, more preferably an alkylphenone compound or a phosphine oxide compound, still more preferably a photopolymerization initiator having an α-hydroxyacetophenone structure or an acylphosphine oxide structure.

These polymerization initiators may be used alone or in combination of two or more kinds. The polymerization initiator is usually used in an amount of 0.1 to 40 mass parts, preferably 0.5 to 20 mass parts, relative to 100 mass parts of the multi-functional radical polymerizable compound.

[Solvent]

Examples of a solvent used for formation of the surface layer include: methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, and diethylamine. However, the present invention is not limited to them.

These solvents may be used alone, or they may be used by mixing two or more kinds.

As a method of dispersing the conductive filler having been subjected to a specific surface treatment of the present invention, it may be used: an ultrasonic disperser, a ball mill, a sand mill, and a homo mixer. However, the present invention is not limited to them.

Examples of a coating method are known method such as: a dip coating method, a spray coating method, a spinner coating method, a bead coating method, a blade coating method, a beam coating method, a slide hopper method, and a method using a circular slide hopper coating apparatus. By considering the ability to coat without deteriorating the dispersion condition of the conductive filler having been subjected to a specific surface treatment, it is specifically preferable to coat with a method using a circular slide hopper coating apparatus.

In the curing treatment, it is preferable to make polymerization via generation of a radical by irradiating the coated layer with active rays, and to cure with forming a cross-linking bond by cross-linking reaction of intra and inter molecules, to result in forming a binder resin for a surface layer. As the active rays, it is preferable to use lights such as UV rays, or visible rays, or electron beams. In view of the easy handling, the use of UV rays is particularly preferable.

Examples of a UV source include: a low-pressure mercury lamp, a middle-pressure mercury lamp, a high-pressure mercury lamp, an ultrahigh-pressure mercury lamp, a carbon-arc lamp, a metal halide lamp, a xenon lamp, a flash (pulsed) xenon lamp, and a UV LED.

The conditions of emitting actinic rays may vary depending on the type of the lamp. The dose of actinic rays is usually 1 to 20 mJ/cm$^2$, preferably it is 5 to 15 mJ/cm$^2$.

The output power of the light source is preferably 0.1 to 5 kW, particularly preferably it is 0.5 to 3 kW.

A curtain beam-type electron beam emitting device is preferably used as an electron beam source. The accelerating voltage during emission of electron beams is preferably 100 to 300 kV. The absorbed dose is preferably 0.005 Gy to 100 kGy (0.5 to 10 Mrad).

An only requirement of an irradiation time of the active rays is to obtain a necessary amount of irradiation of the active rays. Specifically, the irradiation time is preferably 0.1 second to 10 minute. From the viewpoint of curing efficiency or operation efficiency, more preferable time is 1 second to 5 minutes.

The coating film may be subjected to a drying treatment before or after, or during the irradiation with active rays. The timing to perform the drying treatment may be suitably selected by combining the irradiating conditions of active rays. The drying conditions of the surface layer are suitably selected depending on the kind of solvent used in the coating liquid or the thickness of the surface layer. The drying temperature is preferably room temperature to 180° C., more preferably it is 80 to 140° C. The drying time is preferably 1 to 200 minutes, more preferably it is 5 to 500 minutes. By drying the coating film under these conditions, the amount of the solvent contained in the surface layer can be controlled to be in the range of 20 ppm to 75 ppm.

In the following, it will be described other configuration members of the photoreceptor than the surface layer.

[Conductive Support 1*a*]

Any conductive support can be used in the present invention as long as it has conductivity. Examples of a conductive support include: drums and sheets formed of metals, such as aluminum, copper, chromium, nickel, zinc, and stainless steel; plastic films laminated with metal foil of aluminum or copper; plastic films provided with deposited layers of aluminum, indium oxide, or tin oxide; and metal and plastic films and paper sheets having conductive layers formed through application of a conductive substance alone or in combination with a binder resin.

[Intermediate Layer 1*b*]

An intermediate layer of the present invention provides a barrier function and an adhesive function between the conductive support and the organic photosensitive layer. From the viewpoint of preventing various failures, it is preferable to locate this intermediate layer.

This intermediate layer contains a binder resin (hereafter, it is also called as "a binder resin for an intermediate layer"), and conductive particles and metal oxide particles when required.

Examples of a binder resin for an intermediate layer include: casein, poly(vinyl alcohol), nitrocellulose, ethylene-acrylic acid copolymers, polyamides, polyurethanes, and gelatin. Among these binder resins, preferred are alcohol-soluble polyamide resins.

The intermediate layer may contain any conductive particles or metal oxide particles for controlling the resistance. Examples thereof include: particles of metal oxides, such as alumina, zinc oxide, titanium oxide, tin oxide, antimony oxide, indium oxide, and bismuth oxide; and ultrafine particles of tin-doped indium oxide, antimony-doped tin oxide, and antimony-doped zirconium oxide.

Such metal oxide particles preferably have a number average primary particle size of 0.3 μm or less, more preferably it is 0.1 μm or less.

These metal oxide particles may be used alone or in combination of two or more kinds. A mixture of two or more metal oxides particles may be in the form of solid solution or fusion.

The amount of conductive particles or metal oxide particles is preferably 20 to 400 mass parts, more preferably 50 to 200 mass parts with respect to 100 mass part of the binder resin for an intermediate layer.

The above-described intermediate layer may be formed as follows. For example, a binder resin for an intermediate layer is dissolved in a known solvent, then, conductive particles or metal oxide particles are dispersed when needed. Thus, a coating liquid for forming an intermediate layer is prepared. This coating liquid for forming an intermediate layer is applied on the surface of a conductive support to form a coating film. An intermediate layer is produced by drying this coating film.

Solvents used for formation of the intermediate layer are not particularly limited. Examples of a usable solvent are: n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichlorethylene, tetrachloroethane, tetrahydrofuran, dioxolane, dioxane, methanol, ethanol, butanol, isopropanol, ethyl acetate, butyl acetate, dimethyl sulfoxide, and methyl cellosolve. Of these, toluene, tetrahydrofuran, and dioxolane are preferably used. These solvents may be used alone, or they may be used as a mixed solvent of two or more kinds.

As a dispersing method of the conductive particles or the metal oxide particles, it may be cited: an ultrasonic disperser, a ball mill, a sand mill, and a homo mixer.

Although a coating method of the coating liquid for an intermediate layer is not specifically limited, it may be cited a dip coating method and a spray coating method, for example.

A drying method of the coating film may be suitably selected from the known drying methods according to the kinds of solvent and the thickness of the formed intermediate layer.

The thickness of the intermediate layer is preferably 0.1 to 15 μm, more preferably it is 0.3 to 10 μm.

[Charge Generating Layer 1*c*]

The charge generating layer in the present invention contains a charge generating material and a binder resin (hereafter, it is also called as "a binder resin for a charge generating layer").

Examples of a charge generating material include: azo pigments such as Sudan Red and Diane Blue; quinone pigments such as pyrenequinone and anthanthrone; quinocyanine pigments; perylene pigments; indigo pigments such as indigo and thioindigo; polycyclicquinone pigments such as pyranthlone and diphthaloyl pyrene; and phthalocyanine pigments. The present invention is not limited to them. Among these, polycyclic quinone pigments and titanyl phthalocyanine pigments are preferable.

These charge generating materials may be used alone, or they may be used by mixing two or more kinds.

Known resins can be used as a binder resin for a charge generating layer. Examples thereof include: polystyrene resins, polyethylene resins, polypropylene resins, acrylic resins, methacrylic resins, vinyl chloride resins, vinyl acetate resins, poly(vinyl butyral) resins, epoxy resins, polyurethane resins, phenolic resins, polyester resins, alkyd resins, polycarbonate resins, silicone resins, melamine resins, copolymer resins containing two or more of these resins (e.g., vinyl chloride-vinyl acetate copolymer resins and vinyl chloride-vinyl acetate-maleic anhydride copolymer resins), and poly(vinylcarbazole) resins. The present invention is not limited to them. Among these, poly(vinyl butyral) resins are preferable.

The amount of the charge generating material contained in the charge generating layer is preferably 1 to 600 mass parts with respect to 100 mass parts of the binder resin for the charge generating layer. More preferably, the amount is 50 to 500 mass parts.

The charge generating material mixed with the binder resin for the charge generating layer is preferably contained in an amount of 20 to 600 mass parts, more preferably 50 to 500 mass parts, with respect to 100 mass parts of the binder resin for the charge generating layer. By making the mixing ratio of the binder resin and the charge generating material in the charge generating layer to be in the above-described ratio, the coating liquid for forming the charge generating layer will acquire high dispersion stability. In addition, the produced photoreceptor will have a reduced electro resistance, and it can highly prevent increase of the residual electric potential caused by repeated use of the photoreceptor.

The above-described charge generating layer may be formed as follows. For example, a charge generating material is added to a binder resin for a charge generating layer dissolved in a known solvent. The mixture is dispersed to prepare a coating liquid for forming a charge generating layer. This coating liquid for forming a charge generating layer is applied on the surface of the intermediate layer to form a coating film. A charge generating layer is produced by drying this coating film.

The solvent used for formation of the charge generating layer is not particularly limited as long as it can dissolve the binder resin for the charge generating layer. Examples of the solvent are: ketone type solvents such as methyl ethyl ketone, methyl isopropyl ketone, methyl isobutyl ketone, cyclohexanone, and acetophenone; ether type solvents such as tetrahydrofuran, dioxolane, and diglyme; alcohol type solvents such as methyl cellosolve, ethyl cellosolve, and butanol; ester type solvents such as ethyl acetate and t-butyl acetate; aromatic solvents such as toluene and chlorobenzene; and halogenated solvents such as dichloroethane and trichloroethane. However, the present invention is not limited to them. These solvents may be used alone, or they may be used by mixing two or more kinds.

As a dispersion method of a charge generating material, it may be cited the same dispersion methods used for dispersing the conductive particles or the metal oxide particles in the coating liquid for forming the intermediate layer.

As a coating method of the coating liquid for forming the charge generating layer, it may be cited the same coating methods cited for the coating liquid for forming the intermediate layer.

The thickness of the charge generating layer may vary depending on the properties of the charge generating material, the properties of the binder resin, or the amount of the binder resin contained in the layer. The thickness is preferably 0.1 to 2 μm, more preferably it is 0.15 to 1.5 μm.

[Charge Transporting Layer 1*d*]

The charge transporting layer in the present invention contains at least a charge transporting material and a binder resin (hereafter, it is also called as "a binder resin for a charge transporting layer").

Examples of a charge transporting material which carries charge in a charge transporting layer are: triphenylamine derivatives, hydrazone compounds, styryl compounds, benzidine compounds, and butadiene compounds.

Examples of a binder resin for a charge transporting layer include known resins such as: polycarbonate resins, polyacrylate resins, polyester resins, polystyrene resins, styrene-acrylonitrile copolymer resins, polymethacrylate resins, and styrene-methacrylate copolymer resins. Of these, polycarbonate resins are preferably used. More preferred are polycarbonate resins, such as Bisphenol A (BPA), Bisphenol Z (BPZ), dimethyl BPA, and BPA-dimethyl BPA copolymers, from the viewpoints of cracking resistance, wear resistance, and charging characteristics.

The amount of the charge transporting material contained in the charge transporting layer is preferably 10 to 500 mass parts with respect to 100 mass parts of the binder resin for the charge transporting layer. More preferably, the amount is 20 to 250 mass parts.

The charge transporting layer may contain additives such as an antioxidant, an electron conducting agent, a stabilizer and a silicone oil. Preferable antioxidants are disclosed in JP-A No. 2000-305291. And preferable electron conducting agents are disclosed in JP-A Nos. S50-137543 and S58-76483.

The charge transporting layer may have any thickness depending on the properties of the charge transporting material or the binder resin, or the amount of the binder resin contained in the layer. The thickness is preferably 5 to 40 μm, more preferably it is 10 to 30 μm.

The above-described charge transporting layer is formed as follows. For example, a charge transporting material (CTM) is added to a binder resin for a charge transporting layer dissolved in a known solvent. The mixture is dispersed to prepare a coating liquid for forming a charge transporting layer. This coating liquid for forming a charge transporting layer is applied on the surface of the charge generating layer to form a coating film. A charge transporting layer is produced by drying this coating film.

As a solvent used for formation of the charge transporting layer, it can be cited the same solvent used for formation of the charge generating layer.

As a coating method of the coating liquid for forming the charge transporting layer, it may be cited the same coating methods cited for the coating liquid for forming the charge generating layer The above-described photoreceptor has the surface layer 1*e* containing the binder resin for the surface layer having therein the conductive filler 1*e*A that has been subjected to the specific surface treatment. By this composition, the photoreceptor exhibits high strength and an excellent cleaning property, at the same time, the photoreceptor has a required electric property to result in forming an image of high quality.

[Image-Forming Apparatus]

The photoreceptor of the present invention can be provided in a common image-forming apparatus employing an electrophotographic method. The image-forming apparatus of the present invention includes: a photoreceptor; a charging unit to charge a surface of the photoreceptor; an exposing unit to form an electrostatic latent image on the surface of the photoreceptor; a developing unit to develop the electrostatic latent image with a toner into a toner image; a transferring unit to transfer the toner image on a transfer medium; a fixing unit to fix the transferred toner image; and a cleaning unit to remove the residual toner on the photoreceptor.

Figure 2:
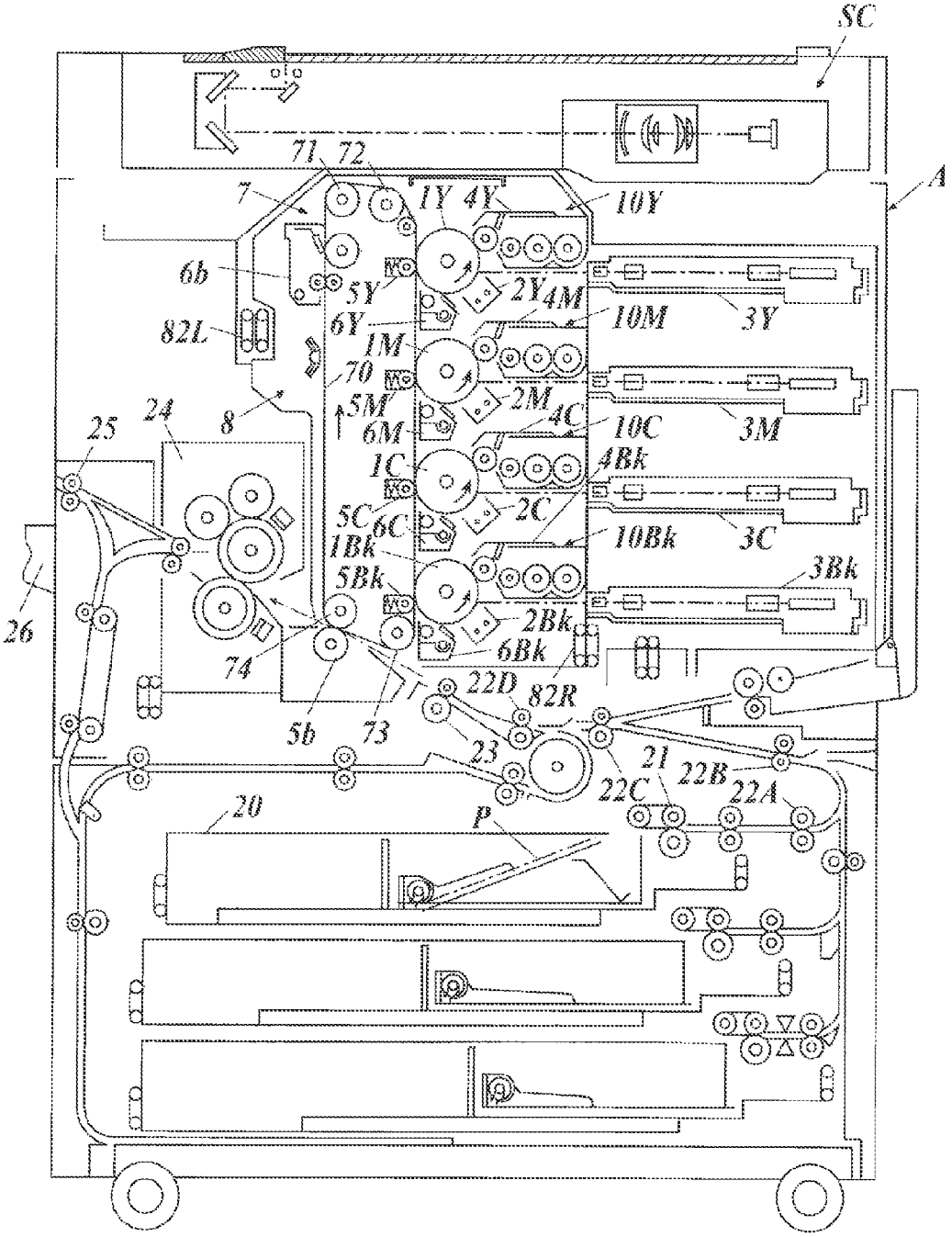
FIG. 2 is a cross-sectional view illustrating a structural example of an image-forming apparatus provided with an electrophotographic photoreceptor of the present invention.

FIG. 2 is a cross-sectional view of an example of an electrophotographic image-forming apparatus provided with a photoreceptor of the present invention.

This image-forming apparatus is called as a tandem color image-forming apparatus, and it includes four image-forming units 10Y, 10M, 10C, and 10Bk, an intermediate transferring unit 7, a sheet feeding unit 21, and a fixing unit 24. The image-forming apparatus further includes a document scanner SC above a body A of the image-forming apparatus.

The four image-forming units 10Y, 10M, 10C, and 10Bk each respectively include the drum photoreceptors 1Y, 1M, 1C, and 1Bk at the center, and in the rotation order of the photoreceptor 1Y, the charging units 2Y, 2M, 2C, and 2Bk, the exposing units 3Y, 3M, 3C, and 3Bk, the developing units 4Y, 4M, 4C, and 4Bk, the primary transfer device respectively composed of: the primary transfer rollers 5Y, 5M, 5C, and 5Bk, and the cleaning units 6Y, 6M, 6C, and 6Bk for cleaning the drum photoreceptor 1Y, 1M, 1C, and 1Bk.

The image-forming apparatus of the present invention employs the above-described photoreceptor of the present invention as the photoreceptors 1Y, 1M, 1C, and 1Bk.

The image-forming units 10Y, 10M, 10C, and 10Bk have the same configuration except for the colors (yellow, magenta, cyan and black) of toner images formed on the photoreceptors 1Y, 1M, 1C, and 1Bk. Thus, the following description focuses on the image-forming unit 10Y as an example.

The image-forming unit 10Y includes the charging unit 2Y, the exposing unit 3Y, the developing unit 4Y, the primary transfer roller 5Y, and the cleaning unit 6Y, which are disposed around the drum photoreceptor 1Y (image retainer). The image-forming unit 10Y forms a yellow (Y) toner image on the photoreceptor 1Y.

The charging unit 2Y provides the drum photoreceptor 1Y with a uniform electric potential. In the present embodiment, the charger of corona discharge mechanism is employed.

The exposing unit 3Y exposes the drum photoreceptor 1Y provided with the uniform potential by the charging unit 2Y in response to image signals (yellow) to form an electrostatic latent image corresponding to the yellow image. The exposing unit 3Y includes light-emitting devices (LEDs) arrayed in the axial direction of the drum photoreceptor 1Y and an imaging element, or includes a laser optical device.

The developing unit 4Y is composed of: a developing sleeve which includes a magnet and rotating with holding a developer; and a voltage applying device to apply a DC or AC bias voltage between the photoreceptor 1Y and this developing sleeve.

The primary transfer roller 5Y is a device to transfer the toner image formed in the photoreceptor 1Y to the intermediate transferring belt 70 in the endless-belt form. The primary transfer roller 5Y is arranged in such a manner to abut the intermediate transferring belt 70.

The cleaning unit 6Y is composed of: a cleaning blade; and a brush roller located in the upstream side of the cleaning blade, for example.

In this image-forming apparatus, among the image-forming unit 10Y, the photoreceptor 1Y, the developing unit 2Y, and the cleaning unit 6Y, may be integrated into a processing cartridge. The processing cartridge may be detachably provided on the body A of the image-forming apparatus via a guiding device such as a rail.

As a fixing unit 24, it can be cited a heat-roller type fixing device composed of: a heat roller incorporating a heat source inside thereof; and a pressure roller which forms a nip portion at the heat roller in such a manner to abut the heat roller.

The image-forming units 10Y, 10M, 10C, and 10Bk are aligned in the vertical direction. The intermediate transferring unit 7 is disposed on the left of the photoreceptors 1Y, 1M, 1C, and 1Bk in FIG. 2.

The intermediate transferring unit 7 includes: the intermediate transferring belt 70 of semi-conductor in an endless-belt form, and rotatably wound around rollers 71, 72, 73, and 74; the first transferring rollers 5Y, 5M, 5C, and 5Bk, located in the inside of the intermediate transferring belt 70; and the cleaning unit 6*b*.

The image-forming units 10Y, 10M, 10C, and 10Bk, and the intermediate transferring unit 7 are accommodated in a housing 8. The housing 8 has a structure which can be drawn from the apparatus body A via rails 82L and 82R.

In the image-forming apparatus having a composition as described above, the toner image is formed by the image-forming units 10Y, 10M, 10C, and 10Bk. Specifically, at first, the surfaces of the photoreceptors 1Y, 1M, 1C, and 1Bk are negatively charged with the charging units 2Y, 2M, 2C, and 2Bk. Subsequently, the surfaces of the photoreceptors 1Y, 1M, 1C, and 1Bk are exposed corresponding to the image signals by the exposing units 3Y, 3M, 3C, and 3Bk to form an electrostatic latent image. Then, the toners are given to the surface of the photoreceptors 1Y, 1M, 1C, and 1Bk by the developing unit 4Y, 4M, 4C, and 4Bk to develop the electrostatic latent image and to form a toner image of each color.

The color images formed by the image-forming units 10Y, 10M, 10C, and 10Bk are sequentially transferred onto the rotating intermediate transferring belt 70 with the respective first transferring rollers 5Y, 5M, 5C, and 5Bk, to form a synthesized color image.

A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* (second transferring unit) via multiple intermediate rollers 22A, 22B, 22C, and 22D and register rollers 23.

The color image on the intermediate transferring belt 70 is transferred at once onto the transfer medium P by abutting the second transferring roller 5*b* to the intermediate transferring belt 70. The color image transferred on the transfer medium P is separated at the portion of the intermediate transferring belt 70 having a high curvature and it is transported in the fixing unit 24. The color image is fixed by the fixing unit 24. The transfer medium P is then pinched between discharging rollers 25 and is conveyed to a sheet receiving tray 26 provided outside of the apparatus.

After transferring the toner images of each color to the intermediate transferring belt 70 with the first transferring rollers 5Y, 5M, 5C, and 5Bk, the residual toners on the photoreceptors 1Y, 1M, 1C, and 1Bk are removed by the cleaning units 6Y, 6M, 6C and 6Bk.

After transferring the color image onto the transfer material P with the second transferring roller 5*b* and after conducting the curved separation of the transfer material P from the intermediate transferring belt 70, the residual toner on the intermediate transferring belt 70 is removed by the cleaning unit 6*b*.

The first transferring roller 5Bk abuts the photoreceptor 1Bk all the time during the image formation. The first transferring rollers 5Y, 5M, and 5C abut the respective photoreceptors 1Y, 1M, and 1C only during the formation of a color image.

The second transferring roller 5*b* abuts the intermediate transferring belt 70 only during passage of the transfer material P therebetween for the second transferring operation.

In FIG. 2, the image-forming apparatus is illustrated as a color laser printer. However, the photoreceptor of the present invention can be applied similarly to a monochromatic laser printer, or a copier. Further, in this image-forming apparatus, a light source other than a laser, such as an LED light source, may be used as an exposing light source.

[Toner and Developer]

A toner used for an image-forming apparatus provided with a photoreceptor of the present invention may be a pulverized toner or a polymerized toner. In an image-forming apparatus according to the present invention, a polymerized toner prepared with a polymerization method is preferably employed from the viewpoint of obtaining an image of high quality.

A polymerized toner designates a toner which is prepared in such a manner that formation of the binder resin and the formation of the toner particles, both being elements constituting the toner, are done simultaneously. That is, the polymerization of the raw material monomer to obtain the binder resin and the chemical treatment to the binder resin when required are done side by side.

More specifically, a polymerized toner is a toner obtained by the step of producing resin particles via polymerization reaction such as suspension polymerization or emulsion polymerization; and by the step of fusing the produced resin particles done afterward when needed.

As the toner used for an image-forming apparatus provided with a photoreceptor of the present invention, it is preferable to use a toner containing a binder resin made of a crystalline resin. By using a toner containing a binder resin made of a crystalline resin, generation of fog can be prevented in the produced image. This is supposed to be resulted from the decrease of charge variation when the toner is triboelectric-charged in the developing units 4Y, 4M, 4C, and 4Bk.

A volume average particle size of the toner, namely the 50% volume particle size (Dv50), is preferably 2 to 9 μm, more preferably it is 3 to 7 μm. By making the size of the toner to be in this range, the resolution of the image can be increased. Further, by making the size of the toner to be in this range, the prepared toner may decrease the amount of the toner having a fine particle size while keeping a small particle size. As a result, the dot image reproduction property may be improved over a long period of time, and the toner can form an image of high resolution and high stability.

The toner according to the present invention may be used as a mono-component developer by using singly, or may be used as a two-component developer by mixing with a carrier.

When the toner is used as a mono-component developer, it may be used as a non-magnetic mono-component developer, or a magnetic mono-component developer with incorporating magnetic particles having a size of about 0.1 to 0.5 μm in the toner. These developers can be used.

When the toner is used as a two-component developer by mixing with a carrier, the known materials may be used for the magnetic particles as a carrier. Examples thereof are: metals such as iron, ferrite, and magnetite; and alloys with these metals with aluminum or lead. Among them, ferrite particles are particularly preferable. It is preferable that the above-described magnetic particles have a volume average particle size of 15 to 100 μm, more preferably it is 25 to 80 μm.

The measurement of the volume average particle size of the carrier can be done, for example, with a laser diffraction particle distribution apparatus "HELOS" provided with a wet dispersion device (made by SYMPATEC Co. Ltd.).

A preferable carrier is made of magnetic particles covered with a resin, or so-called a resin dispersion type carrier made of magnetic particles dispersed in a resin. Although a resin component for coating the magnetic particles is not specifically limited, examples of a usable resin are: olefin resins, styrene resins, styrene-acrylic resins, silicone resins, ester resins, and fluorinated polymer resins. As a resin for constituting the resin dispersion type carrier, known resins can be used without any limitation. Examples of the usable resin are: styrene-acrylic resins, polyester resins, fluoro-resins, and phenol resins.

As stated above, the specific embodiments of the present invention were described. However, the embodiments of the present invention are not limited to them, and various modifications can be made to them.

EXAMPLES

Specific examples of the present invention will be described in the following. However, the present invention is not limited to them.

Synthetic Example 1 of Fluoroalkyl (meth)acrylate/(meth)acrylic acid copolymer In a reaction vessel were placed 9.9 g of 2,2,3,3,4,4,4-heptafluorobutyl methacrylate, 0.1 g of acrylic acid, 0.3 g of polymerization initiator "PEROYL™ SA" (made by NOF Co. Ltd.), and 60.0 g of methyl perfluorobutyl ether (fluorine solvent) (made by Tokyo Chemical Industry Co. Ltd.). A dry nitrogen gas was introduced in the reaction vessel to purge the air and the reaction vessel was sealed hermetically. The mixture was heated at 70° C. for 24 hours with stirring. Afterward, the reaction vessel was cooled, and then opened. Subsequently, the liquid in the reaction vessel was poured into 300 mL of methanol. The produced polymer was precipitated, and then, it was dried under a vacuum condition to obtain a specific fluorinated surface treatment agent (A) composed of 2,2,3,3,4,4,4-heptafluorobutyl methacrylate/acrylic acid copolymer.

Synthetic Example 2 of Fluoroalkyl (meth)acrylate/(meth)acrylic acid copolymer The reaction was done in the same manner as Synthetic example 1 of fluoroalkyl (meth)acrylate/(meth)acrylic acid copolymer, except that 2,2,3,3,4,4,4-heptafluorobutyl methacrylate was replaced with 2,2,3,3-tetrafluoropropyl methacrylate, and acrylic acid was replaced with methacrylic acid. Thus, it was obtained a specific fluorinated surface treatment agent (B) composed of 2,2,3,3-tetrafluoropropyl methacrylate/methacrylic acid copolymer.

Synthetic Example 3 of Fluoroalkyl (meth)acrylate/(meth)acrylic acid copolymer The reaction was done in the same manner as Synthetic example 1 of fluoroalkyl (meth)acrylate/(meth)acrylic acid copolymer, except that 2,2,3,3,4,4,4-heptafluorobutyl methacrylate was replaced with 2,2,3,3,4,4,5,5,5-nonafluoropentyl methacrylate. Thus, it was obtained a specific fluorinated surface treatment agent (C) composed of 2,2,3,3,4,4,5,5,5-nonafluoropentyl methacrylate/acrylic acid copolymer.

Preparation Example 1 of Conductive Filler

To 10 mL of methanol was added 5 g of tin oxide (having a number average primary particle size of 20 nm). The mixture was dispersed for 30 minutes with a US homogenizer. Then, 0.35 g of 3-methacryloxypropyl trimethoxy silane ("KMB503" made by Shin-etsu Silicone Co. Ltd.) as a coupling agent and 10 mL of toluene were added to the dispersion, and it was stirred at room temperature for 1 hour. After removing the solvent with an evaporator, the mixture was heated at 120° C. for 1 hours to obtain a conductive filler (a) having been subjected to a surface treatment with a coupling agent.

To 40 g of 2-butanol was added 5 g of the obtained conductive filler (a). The mixture was dispersed for 60 minutes with a US homogenizer. Then, 10 g of methyl perfluorobutyl ether was added to the dispersion. Then, 15 g of the above-described specific fluorinated surface treatment agent (A) was added, and the mixture was further dispersed for 60 minutes with a US homogenizer. The dispersion was done by confirming the dispersion degree with a particle size distribution meter. After completion of the dispersion, the solvent was removed at room temperature. The obtained powder material was passed through a sieve having a pore of 100 μm and 60 μm. The filtered powder was dried at 80° C. for 60 minutes to obtain a conductive filler (1) having been subjected to a specific surface treatment.

Preparation Examples 2 to 8 of Conductive Filler

Conductive fillers (2) to (8) each having been subjected to a specific surface treatment were prepared in the same manner as preparation of the conductive filler (1), except that the kind of the untreated conductive filler as well as the kind and the amount of the specific fluorinated surface treatment agent were changed as indicated in Table 1.

In Table 1, "AKT877" indicates a titanium coupling agent of titanium methacrylate triisopropoxide.

Preparation Example 9 of Conductive Filler

A conductive filler (9) having been subjected to a specific surface treatment was prepared in the same manner as preparation of the conductive filler (1), except that the treatment with a coupling agent was not conducted.

Preparation Example 10 of Conductive Filler

Tin oxide (having a number average primary particle size of 100 nm) itself was used as a conductive filler (10).

Preparation Example 11 of Conductive Filler

A conductive filler (11) was prepared in the same manner as preparation of the conductive filler (1), except that the kind of the used untreated conductive filler was changed as indicated in Table 1, and the treatment with a specific fluorinated surface treatment agent was not conducted.

Example 1

Preparation of Photoreceptor (1)

(1) Preparation of Conductive Support

A conductive support (1) was prepared through milling of the surface of a cylindrical aluminum support having a diameter of 60 mm.

(2) Preparation of Intermediate Layer

An intermediate layer 1 was prepared as follows.

100 mass parts of polyamide resin "CM 8000" (made by Toray Co. Ltd., a binder resin for an intermediate layer) were added to 1,700 mass parts of mixed solvent composed of ethanol/n-propyl alcohol/tetrahydrofuran (volume ratio: 45/25/35). The mixture was stirred at 20° C.

To this solution were added 120 mass parts of titanium oxide particles "SMT500SAS" (mad by TEIKA Co. Ltd.) and 160 mass parts of titanium oxide particles "SMT150MK" (mad by TEIKA Co. Ltd.). The mixture was dispersed in a bead mill for the mill staying time of 5 hours. The mixture was left still for one day, then, it was filtered. Thus a coating liquid for forming an intermediate layer was obtained. The filtration was done by using Rigimesh™ filter having a nominal precision of 5 μm (made by Japan Pore Co. Ltd.) with a pressure of 50 kPa. Thus obtained coating dispersion for forming an intermediate layer was applied to the outer surface of the washed conductive support (1). Subsequently, the coated layer was dried at 120° C. for 30 minutes to obtain an intermediate layer (1).

(3) Preparation of Charge Generating Layer

A coating dispersion for a charge generating layer (1) was prepared through mixing of the following materials with a sand mill for 10 hours.

Charge Generating Material:

| | |
|---|---|
| Titanylphthalocyanine pigment (having at least a maximum diffraction peak at 27.3° as measured by Cu-Kα X-ray diffractometry) | 20 mass parts |
| Binder resin for charge generating layer: | |
| Poly(vinyl butyral) resin (#6000-C: made by Denka Co. Ltd.) | 10 mass parts |
| Solvent: t-Butyl acetate | 700 mass parts |
| Solvent: 4-Methoxy-4-methyl-2-pentanone | 300 mass parts |

The above-described coating dispersion (1) was applied onto the intermediate layer (1) through dip coating, and the resultant film was dried to form a charge generating layer (1) having a thickness of 0.3 μm.

(4) Preparation of Charge Transporting Layer

A coating solution for a charge transporting layer (1) was prepared through mixing and dissolution of the following materials.

| | |
|---|---|
| Charge transporting material: 4,4'-dimethyl-4''-(β-phenylstyryl)triphenylamine | 225 mass parts |
| Binder resin for charge transporting layer: | |
| polycarbonate resin "Z300" (made by Mitsubishi Gas Chemical Co. Inc.) | 300 mass parts |
| Solvent: Tetrahydrofuran | 1,600 mass parts |
| Solvent: Toluene | 400 mass parts |

-continued

| | |
|---|---|
| Antioxidant: BHT | 6 mass parts |
| Silicone oil "KF-96" (made by Shin-Etsu Chemical Co., Ltd.) | 1 mass parts |

The coating solution (1) was applied onto the charge generating layer (1) through dip coating, and the resultant film was dried to form a charge transporting layer (1) having a thickness of 20 μm.

(5) Formation of Surface Layer

The following materials were mixed under the dark condition.

| | |
|---|---|
| Conductive filler (1) | 85 mass parts |
| Exemplary compound (M-1) (multi-functional radical polymerizable compound) | 100 mass parts |
| Tetrahydrofuran (solvent) | 40 mass parts |

Subsequently, 10 mass part of polymerization initiator indicated by the following Structure (P) was added to prepare a coating liquid (1) for forming a surface layer. This coating liquid (1) for forming a surface layer was applied on the charge transporting layer (1) with a circular slide hopper coating apparatus to form a coating layer. The coating layer was irradiated by UV rays with a metal halide lamp for 1 minute. Thus, it was formed a surface layer (1) having a dry thickness of 3.0 μm. By this, a photoreceptor (1) was produced.

Structure (P)

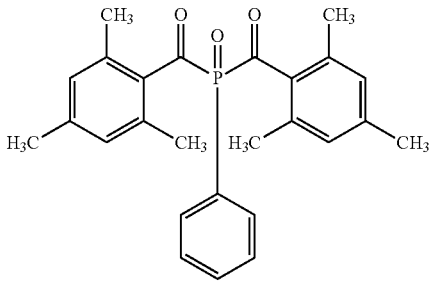

Examples 2 to 9 and Comparative Examples 1 and 2

Preparation of Photoreceptors (2) to (11)

Photoreceptors (2) to (11) each were prepared in the same manner as preparation of a photoreceptor in Example 1, except that the conductive filler (1) was replaced with the conductive fillers (2) to (11) respectively.

(1) Evaluation of Cleaning Property (CL)

An image-forming apparatus "bizhub C554" (made by Konica Minolta, Inc.) was respectively loaded with the photoreceptors (1) to (11). A printing test was done to make 2,000 sheets of print having a printing ratio 5% at the Bk position under the conditions of a temperature of 23° C. and a humidity of 50% RH. The surface of the photoreceptor after this printing test was observed with a microscope. The number of adhered matters in the view range of 20 mm×40 mm on the surface of the photoreceptor was measured. The cleaning property was evaluated according to the following evaluation criteria. The evaluation results are listed in Table 1.

[Evaluation Criteria]

A: No adhered matters are observed. Very good (passing an inspection)

B: The number of adhered matters is 1 to 5. Good (passing an inspection)

C: The number of adhered matters is 6 to 10. No problem for practical use (passing an inspection)

D: The number of adhered matters is 11 or more. Not acceptable for practical use (failing an inspection)

(2) Evaluation of Electric Property

An image-forming apparatus "bizhub C554" (made by Konica Minolta, Inc.) was respectively loaded with the photoreceptors (1) to (11). The initial charging electric potential was set to be 600±30 V under the conditions of a temperature of 23° C. and a humidity of 50% RH. The surface electric potential after exposure was measured. The electric property was evaluated according to the following evaluation criteria. The evaluation results are listed in Table 1.

[Evaluation Criteria]

A: The surface electric potential after exposure is not more than 60 V. Very good (passing an inspection)

B: The surface electric potential after exposure is larger than 60 V to not more than 90 V. Good (passing an inspection)

C: The surface electric potential after exposure is larger than 90 V to not more than 120 V. No problem for practical use (passing an inspection)

D: The surface electric potential after exposure is larger than 120 V. Not acceptable for practical use (failing an inspection)

(3) Evaluation of Fine Line Reproduction

An image-forming apparatus "bizhub C554" (made by Konica Minolta, Inc.) was respectively loaded with the photoreceptors (1) to (11). Under the conditions of a temperature of 23° C. and a humidity of 50% RH, an image of a cross line of one dot was used an image to be copied. This image was copied at the Bk position, and the line width of the cross of the copied image was observed compared with the original image. The fine line reproduction was evaluated according to the following evaluation criteria. The evaluation results are listed in Table 1.

[Evaluation Criteria]

A: The line width is secured. The original image is fully reproduced. Very good (passing an inspection)

B: The line width becomes slightly narrowed. The original image is reproduced. Good (passing an inspection)

C: The line width becomes narrowed. A part of the original image is not reproduced. No problem for practical use (passing an inspection)

D: The original image is not reproduced. Not acceptable for practical use (failing an inspection)

(4) Evaluation of Abrasion Resistance

An image-forming apparatus "bizhub C554" (made by Konica Minolta, Inc.) was respectively loaded with the photoreceptors (1) to (11). Under the conditions of a temperature of 23° C. and a humidity of 50% RH, an abrasion resistance test was done to make 2,000 sheets of prints at the Bk position. The abrasion resistance of the photoreceptor was evaluated from the decreased amount of the thickness of the surface of the photoreceptor before and after this abrasion resistance test.

The specific evaluation way was as follows. The thickness of the surface layer was measured in the portion having a uniform thickness. The portion having a thickness variation at the top portion and the end portion of the coating were avoided by making the thickness profile. The measurement was done at 10 places randomly selected. The average value of thereof was decided to be the thickness. As a thickness measurement apparatus, "EDDY 560C" (Apparatus using an eddy current method, made by HELMUT FISHER GMBTE Co.) was used. The difference of the thickness between before and after the abrasion resistance test was calculated as an amount of decreased thickness (μm).

The abrasion resistance was evaluated according to the following evaluation criteria. The evaluation results are listed in Table 1.

[Evaluation Criteria]

A: The amount of decreased thickness is less than 0.3 μm. Very good (passing an inspection)

B: The amount of decreased thickness is not less than 0.3 to less than 0.6 μm. Good (passing an inspection)

C: The amount of decreased thickness is not less than 0.6 to less than 1.0 μm. No problem for practical use (passing an inspection)

D: The amount of decreased thickness is not less than 1.0 μm. Not acceptable for practical use (failing an inspection)

Formula (1a)

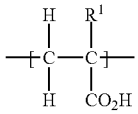

Formula (1b)

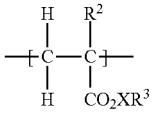

wherein, $R^1$ represents a hydrogen atom or a methyl group, $R^2$ represents a straight-chain or branched-chain alkyl group having 1 to 4 carbon atoms, X represents an alkylene group having 1 to 4 carbon atoms, and $R^3$ represents a perfluoroalkyl group having 1 to 5 carbon atoms.

2. The electrophotographic photoreceptor described in claim 1, wherein the conductive filler is treated with both the surface treatment agent containing the fluoroalkyl (alkyl)acrylate/(meth)acrylic acid copolymer and a coupling agent containing an acryloyl group or a methacryloyl group.

TABLE 1

| | | | Conductive filler having been subjected to a specific surface treatment | | | | | | | | | |
|---|---|---|---|---|---|---|---|---|---|---|---|---|
| | | | Untreated conductive filler | | Coupling agent | | Specific fluorinated surface treatment agent | | Evaluation result | | | |
| | Photoreceptor No. | No. | Kind | Particle size (nm) | Kind | Added amount (mass %) | No. | Added amount (mass %) | CL property | Electric property | Fine line reproducing property | Abrasion resistance property |
| Example 1 | (1) | (1) | $SnO_2$ | 20 | KBM503 | 7 | (A) | 3 | A | A | A | B |
| Example 2 | (2) | (2) | $SnO_2$ | 100 | KBM503 | 3 | (A) | 3 | A | A | B | A |
| Example 3 | (3) | (3) | $SnO_2$ | 20 | AKT877 | 8 | (B) | 1 | C | A | C | B |
| Example 4 | (4) | (4) | $SnO_2$ | 100 | AKT877 | 2 | (C) | 10 | A | B | A | C |
| Example 5 | (5) | (5) | $TiO_2$ | 30 | KBM503 | 7 | (A) | 3 | B | A | B | C |
| Example 6 | (6) | (6) | $SnO_2$ | 300 | KBM503 | 3 | (B) | 5 | A | C | B | B |
| Example 7 | (7) | (7) | $TiO_2$ | 15 | AKT877 | 8 | (A) | 1 | C | A | C | C |
| Example 8 | (8) | (8) | $CuAl_2O_3$ | 50 | KBM503 | 3 | (C) | 5 | A | B | B | C |
| Example 9 | (9) | (9) | $SnO_2$ | 20 | — | | (A) | 3 | B | B | C | C |
| Comparative example 1 | (10) | (10) | $SnO_2$ | 100 | — | | — | | D | B | D | D |
| Comparative example 2 | (11) | (11) | $SnO_2$ | 100 | KBM503 | 7 | — | | D | B | B | C |

What is claimed is:

1. An electrophotographic photoreceptor comprising a conductive support having thereon a photosensitive layer and a surface layer laminated in that order, wherein the surface layer contains a conductive filler having a number average primary particle size of 10 to 500 nm in a resin;

the conductive filler is treated with a surface treatment agent containing a fluoroalkyl (alkyl)acrylate/(meth) acrylic acid copolymer; and the fluoroalkyl (alkyl)acrylate/(meth)acrylic acid copolymer contains both a structure unit represented by Formula (1*a*) and a structure unit represented by Formula (1*b*),

3. The electrophotographic photoreceptor described in claim 1, wherein the conductive filler is at least one selected from the group consisting of titanium oxide, tin oxide and copper alumina.

4. The electrophotographic photoreceptor described in claim 1, wherein the resin which composes the surface layer is a cured resin obtained by polymerization of a cross-linking polymerizable compound containing an acryloyl group or a methacryloyl group.

5. An electrophotographic photoreceptor comprising a conductive support having thereon a photosensitive layer and a surface layer laminated in that order, wherein the surface layer contains a conductive filler having a number average primary particle size of 10 to 500 nm in a resin;

the conductive filler is treated with a surface treatment agent containing a fluoroalkyl (meth)acrylate/(meth) acrylic acid copolymer; and the conductive filler is treated with both the surface treatment agent containing a fluoroalkyl (meth)acrylate/(meth)acrylic acid copolymer and a coupling agent containing an acryloyl group or a methacryoyl group.

6. The electrophotographic photoreceptor described in claim 5, wherein the conductive filler is at least one selected from the group consisting of titanium oxide, tin oxide and copper alumina.

7. An electrophotographic photoreceptor comprising a conductive support having thereon a photosensitive layer and a surface layer laminated in that order, wherein the surface layer contains a conductive filler having a number average primary particle size of 10 to 500 nm in a resin;

the conductive filler is treated with a surface treatment agent containing a fluoroalkyl (meth)acrylate/(meth) acrylic acid copolymer; and the resin which composes the surface layer is a cured resin obtained by polymerization of a cross-linking polymerizable compound containing an acryloyl group or a methacryloyl group.

8. The electrophotographic photoreceptor described in claim 7, wherein the conductive filler is at least one selected from the group consisting of titanium oxide, tin oxide and copper alumina.

* * * * *